US006088935A

United States Patent [19]

Pavelescu et al.

[11] Patent Number: 6,088,935

[45] Date of Patent: Jul. 18, 2000

[54] WATERPROOF SHOE WITH AN INNER SHAFT EXTENSION

[75] Inventors: Liviu-Mihai Pavelescu, Wuppertal; Manfred Haderlein, Haan, both of Germany

[73] Assignee: Akzo Nobel NV, Arnhem, Netherlands

[21] Appl. No.: 09/187,033

[22] Filed: Nov. 6, 1998

[30] Foreign Application Priority Data

Nov. 10, 1997 [DE] Germany ..... 197 49 455
Sep. 11, 1998 [DE] Germany ..... 198 41 566

[51] Int. Cl.[7] ..... A43B 13/38; A43B 23/07

[52] U.S. Cl. ..... 36/14; 36/16; 36/19 R; 36/55

[58] Field of Search ..... 36/12, 14, 16, 36/19 R, 55

[56] References Cited

U.S. PATENT DOCUMENTS 1,579,650 4/1926 Cutler .
1,922,430 8/1933 Game .
1,937,074 11/1933 Vicente .
2,918,735 12/1959 Johnston .
4,599,810 7/1986 Sacre .
5,285,546 2/1994 Haimerl .
5,289,644 3/1994 Driskill et al. .
5,678,326 10/1997 Pavelescu .

FOREIGN PATENT DOCUMENTS

3821602 A1 3/1989 Germany .
195 07 210 C1 10/1996 Germany .

*Primary Examiner*—Ted Kavanaugh
*Attorney, Agent, or Firm*—Oliff & Berridge, PLC

[57] ABSTRACT

A shoe structure includes an outer shaft, an inner shaft and a sole. The inner shaft includes at least one waterproof, water-vapor permeable functional layer and at least one layer of lining material which faces the inside of the shoe structure. An extension, made of a waterproof material, is connected in a waterproof manner to a lower end of the inner shaft which faces an outsole of the shoe. The inner shaft is fixed in place in the sole area by the extension only. The extension preferably encloses the lower end of the inner shaft.

12 Claims, 4 Drawing Sheets

WATERPROOF SHOE WITH AN INNER SHAFT EXTENSION

BACKGROUND OF THE INVENTION

The invention relates to a shoe structure including an outer shaft, an inner shaft and a sole, wherein the inner shaft includes at least one waterproof, water-vapor permeable functional layer and one layer of lining material which faces the inside of the shoe structure.

Shoes of this kind are well known and are characterized by their high degree of wearing comfort. On the one hand, the waterproof functional layer effectively prevents water from penetrating into the inside of the shoe, while on the other hand the humid air caused by the wearer's foot perspiring is able to pass out through the functional layer. It is particularly important with this kind of shoe to design the shoe structure so that penetration by water can be effectively prevented, in particular at the connection points in the sole area between the outer shaft, the inner shaft, the insole and/or the outsole. The connections are generally made by gluing or sewing, but may also be a combination of sewing and gluing.

In one such structure, described in U.S. Pat. No. 4,599,810, the inner shaft is formed in the shape of a sock. All the seams required to achieve the foot shape are waterproofed by gluing waterproof strips over them. This structure requires a large quantity of material for the waterproof, water-vapor permeable functional layer, resulting in increased cost. Also, a waterproof, water-vapor permeable functional layer is not, in most cases, required in the area of the sole, since the sole material underneath the functional layer is often made of waterproof material which is not water-vapor permeable, and therefore there is no advantage gained by providing water-vapor permeable material in the area of the sole. This applies in particular for shoe structures with an outsole that is injection-molded into place. Also, the seams required in the foot area of the inner shaft impair the wearing comfort of a shoe structure of this kind, since these seams often cause pressure points on the foot of the wearer. In this respect, the following attempts were made to reduce the quantity of functional layer in shoe structures of this kind, while at the same time increasing the wearing comfort.

An example of this kind of shoe structure is described in German Patent Publication No. DE-A-38 21 602 for shoe structures with injection molded soles. In this structure the connection between the outer shaft and the inner shaft is made by a porous material which can be penetrated by the injection molding component of the sole material, whereby the sole material penetrates through to the inner shaft and combines with the inner shaft in a waterproof manner. In this process, the connection between the inner shaft and the outer shaft is formed in the critical zones in the contact area between the sole and the upper material. Therefore, this connection is subjected to heavy mechanical stress, particularly in the areas in which the foot rolls. Thus, there is a risk that the waterproof connection may separate, in particular in the areas of the outsole in which the foot rolls, allowing water to penetrate into the inside of the shoe. Also, the waterproof, water-vapor permeable functional layer is generally manufactured as a laminate, of which the side which faces the inside of the shoe is a flat textile structure that is provided for increased wearing comfort, and the side which faces outward is a functional layer which reinforces the flat textile structure. When the porous material is penetrated, the outer flat textile structure which serves to reinforce the functional layer is often not fully penetrated by the sole material. Therefore, penetrating water is able to work its way in as far as the extreme edge of the inner shaft, from where it is then soaked up by the inner flat textile structure, and in this way enters the inside area of the shoe. The critical area in this case as well is the area of the outsole subjected to the constant rolling of the foot.

A further improvement in watertightness is described in DE-A-195 07 210.3. In this structure, the functional layer is extended and turned back toward the inner area of the shoe and the cut edge of the functional layer is connected to the sole material in order to prevent further water penetration. In this construction, too, the connection between the functional layer and the sole material is in a critical area. This means that although the penetration of water is effectively prevented, if the shoes are worn extensively, the connection between the cut edge of the functional layer and the sole material may still also separate in the area in which the foot rolls, in such a manner that individual pores are formed which can transport water into the inner area of the shoe by the capillary action of these pores.

The problem still remains of providing a shoe structure that is watertight and in which there is little risk of water penetration even after extended use of the shoe structure.

SUMMARY OF THE INVENTION

This invention provides a shoe structure which includes an outer shaft, an inner shaft and a sole, wherein the inner shaft comprises at least one waterproof, water-vapor permeable functional layer and at least one layer of lining material which faces the inside of the shoe structure. An extension made of a waterproof material is connected in a waterproof manner to a lower end of the inner shaft which faces an outsole of the shoe. The inner shaft is fixed in place in the sole area by the extension only.

In one aspect of the invention, the critical waterproof connection between the extension and the lower end of the inner shaft which includes the waterproof, water-vapor permeable functional layer is positioned up, away from the critical area that is close to the sole. Therefore, the connection between the lower end of the inner shaft and the extension is not subjected to such a high degree of mechanical stress. The material of the extension can be selected to suit the anticipated degree of mechanical stress. Therefore, the connection of the inner shaft to the sole area via the extension can be made more stable, even under long-term mechanical stress. Additionally, because of the extension, a smaller amount of the laminate which includes the waterproof, water-vapor permeable functional layer is needed, which largely compensates for the additional expense represented by the extra material required for the extension and for attachment of the extension to the inner shaft. Because the material of the extension can be greatly varied, caps or other elements, which are already used in some shoe constructions, can also be used as the extension, provided they are made of waterproof material.

In the context of the invention, the term "shoe structure"refers either to parts of a shoe or an entire shoe to which the invention is applied. For example, in stiffer areas of the sole, such as those which are often found in the area of the heel or, for example, in the toe area of protective shoes due to a stiff shoe cap, it is not absolutely necessary to equip the shoe with the structure of the invention.

In the most simple case, it is sufficient for an extension to be joined in a watertight manner to the inner shaft, preferably on the side of the inner shaft which faces the outside of the shoe structure.

Preferably, the extension includes two extension strips that enclose the lower end of the inner shaft on both sides and are joined to the inner shaft in a waterproof manner.

The extension can be joined in a particularly simple manner to the lower end of the inner shaft if the extension consists of two waterproof extension strips, which are positioned around the circumference of the lower end of the inner shaft. The extension strips are joined in a waterproof manner, partly to the inside and outside surfaces, respectively, of the lower end area of the inner shaft and partly to each other.

Preferably, these strips are formed as continuous loops, the circumference of which corresponds to the circumference of the lower end of the inner shaft. Continuous loops of this kind can, for example, be stamped from a sheet made of waterproof material. The thickness of the sheet should in this case be selected according to the expected degree of mechanical stress. The thickness is generally 0.2 to 1.5 mm, but may be as much as several millimeters in special cases. These sheet-based strips, which may have a circular form, can be shaped into the required form either before or during production of the shoe structure, so that they have a shape in the shoe structure which is suited to the course of the lower end of the outer shaft and then subsequently to the course of the outsole or the insole.

For the shoe structures of the invention, the strips may be adhesive strips, which simplifies further processing. Iron-on adhesive strips have been found particularly effective for this purpose. These iron-on adhesive strips have adhesive which melts on application of heat and, when fluid, is able to effectively penetrate the textile surface covering the functional layer.

Preferably, the lower end area of the inner shaft can be fixed in place so that the inner shaft is connected to the outer shaft and/or the insole exclusively via the extension. This connection is generally made by sewing. Glued connections are also possible, however.

In a shoe structure with a flex construction, in which the lower end of the outer layer is turned back toward the outside and sewn to the insole, and the insole is connected underneath to the outsole'it is preferable for the extension to be positioned between the turned-back end of the outer layer and the insole, and for the turned-back end of the outer layer, the extension and the insole to be sewn together.

In a shoe structure with an adhesive-lasted construction, in which the lower end of the inner shaft and the lower end of the outer shaft are turned back toward the inside and connected, or preferably glued, to the insole from the outside, it is preferable for the connection, possibly glued, between the lower end of the inner shaft and the insole to be made exclusively via the extension.

The extension is generally glued to the lower end of the inner shaft. In the event that the extension is designed so that one extension strip is connected to the lower end of the inner shaft from the outside and one extension strip is connected from the inside, the extension strip positioned on the inside of the inner shaft can also be sewn to the lower end of the inner shaft, since adequate protection against the penetration of water is provided by the strip positioned on the outside.

BRIEF DESCRIPTION OF THE DRAWINGS

Preferred embodiments of this invention will be described in detail, with reference to the sowing figures, in which.

DETAILED DESCRIPTION OF PREFERRED EMBODIMENTS

Figure 1:
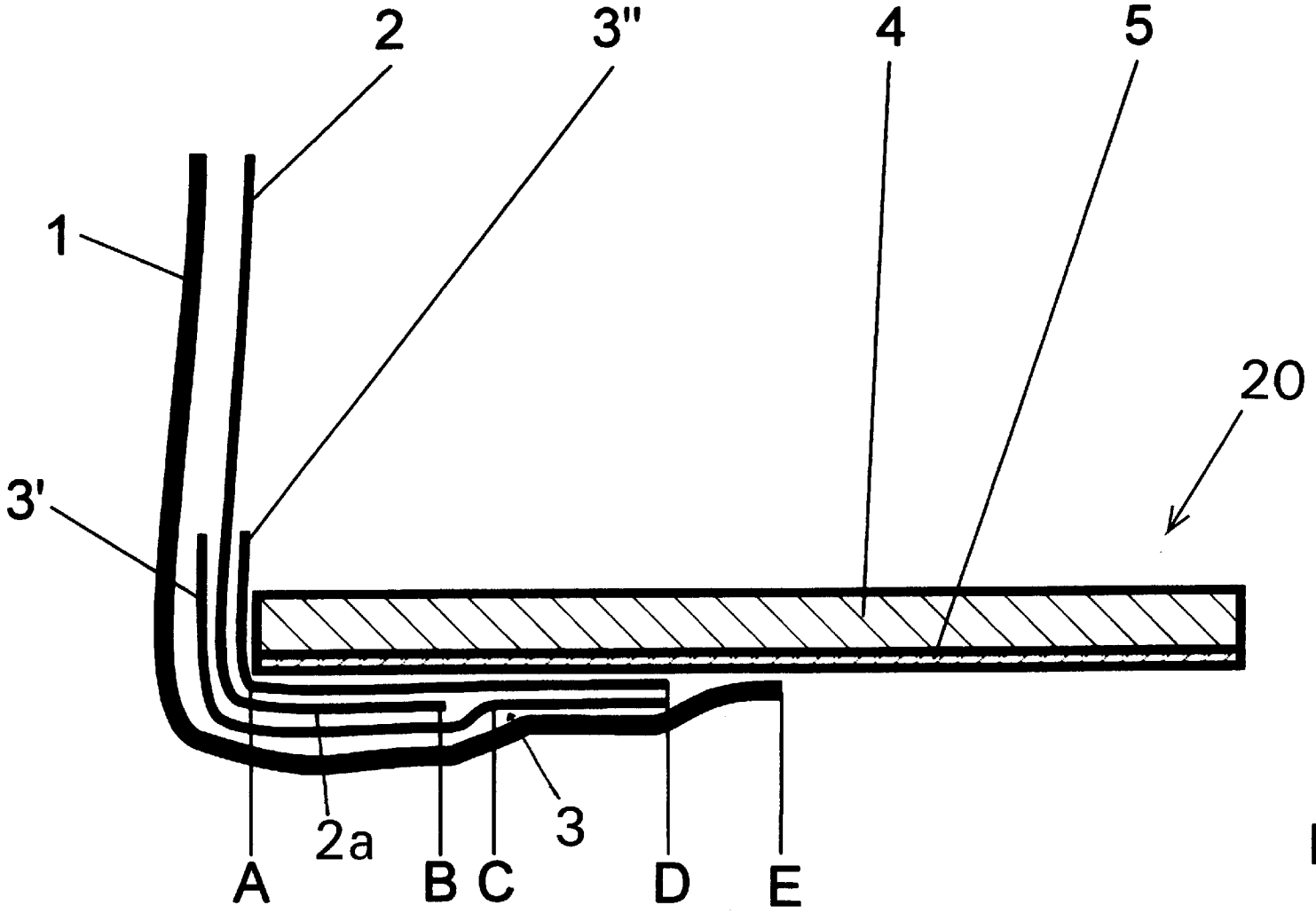
FIG. 1 shows a detail of a shoe structure of a first embodiment of the invention with an adhesive-lasted construction.

FIG. 1 shows a detail of a shoe structure of a first embodiment of the invention with an adhesive-lasted construction. An inner shaft 2, which comprises at least one waterproof, water-vapor permeable functional layer and at least one lining layer which faces the inside of the shoe, has a lower end 2*a*. The lower end 2*a* is enclosed by an extension 3 consisting of extension strips 3' and 3", which are made of a waterproof material. In this embodiment, the extension strips 3' and 3" extend from a point somewhat above an insole 20, along the insole to a point D. The two extension strips 3' and 3" are glued in a waterproof manner to the inner shaft up to point B, then brought together at point C and glued together in a waterproof manner up to point D. The shoe structure of this embodiment also has an outer shaft 1 that covers the inner shaft 2 and the extension 3.

In production of the shoe structure of the invention, the outer shaft 1, the inner shaft 2 and the extension 3 which is glued to the inner shaft 2 are manufactured first, after which the shoe structure is pulled over a last (not shown). Next, the insole 20 is laid on the last from below. The inner shaft 2 is pulled with extension 3 over the insole 20 up to point A and the extension 3 is glued to the insole 20 in a waterproof manner (adhesive-lasted). The outer shaft 1 is then also pulled over the extension 3, which is glued to the insole 20, and the extension 3 is glued in a waterproof manner (adhesive-lasted) to the extension 3 and, in the area between D and E, to the insole.

The glued-together areas of the extension strips 3' and 3" may, alternatively, first be joined to the lower end 2*a* of the outer shaft 1, for example sewn on, and the extension 3 and the end of the outer shaft 1 subsequently pulled over the insole 20 together. In the embodiment illustrated, the insole 20 has two layers 4 and 5. Layer 4 is made of a conventional material, for example leather, while layer 5 is made of a waterproof material. The insole 20 may, however, be made entirely of a waterproof material.

In the embodiment illustrated in FIG. 1, the inner extension strip 3" is not absolutely essential, in which case the outer extension strip 3' is then glued to the insole 20 in a waterproof manner. The inner extension strip 3" can be omitted without the watertightness of the shoe being impaired. In some cases, however, it may be necessary to seal the contact surfaces between the folded-in end portion area of the inner shaft 2 and the bottom insole layer 5, for example with a waterproof adhesive. It can also be useful here to turn back the lower end edge (shown at point B in FIG. 1) of the inner shaft 2 in such a manner that the end of the inner shaft 2 changes direction and is doubled back in part in the direction of point A. The end edge of the inner shaft is thereby positioned between points A and B.

A laminate which is marketed under the brand name SYMPATEX® has proven to be an excellent material for the inner shaft 2. The inner shaft 2 can be sewn to extension strip 3" of the extension 3, for example in the area between points A and B, since the waterproof extension strip 3' covers the inner shaft 2 in this area and is glued to the inner shaft 2 in a waterproof manner. In the adjacent area from point C to point D, the two waterproof extension strips 3' and 3" are also glued to each other in a waterproof manner. Therefore, water is not able to penetrate through to the inner shaft 2. The insole 20 is also waterproofed, at least in the area facing the outsole (not illustrated), so that penetration of water into the inner area of the shoe is practically impossible.

Figure 2:
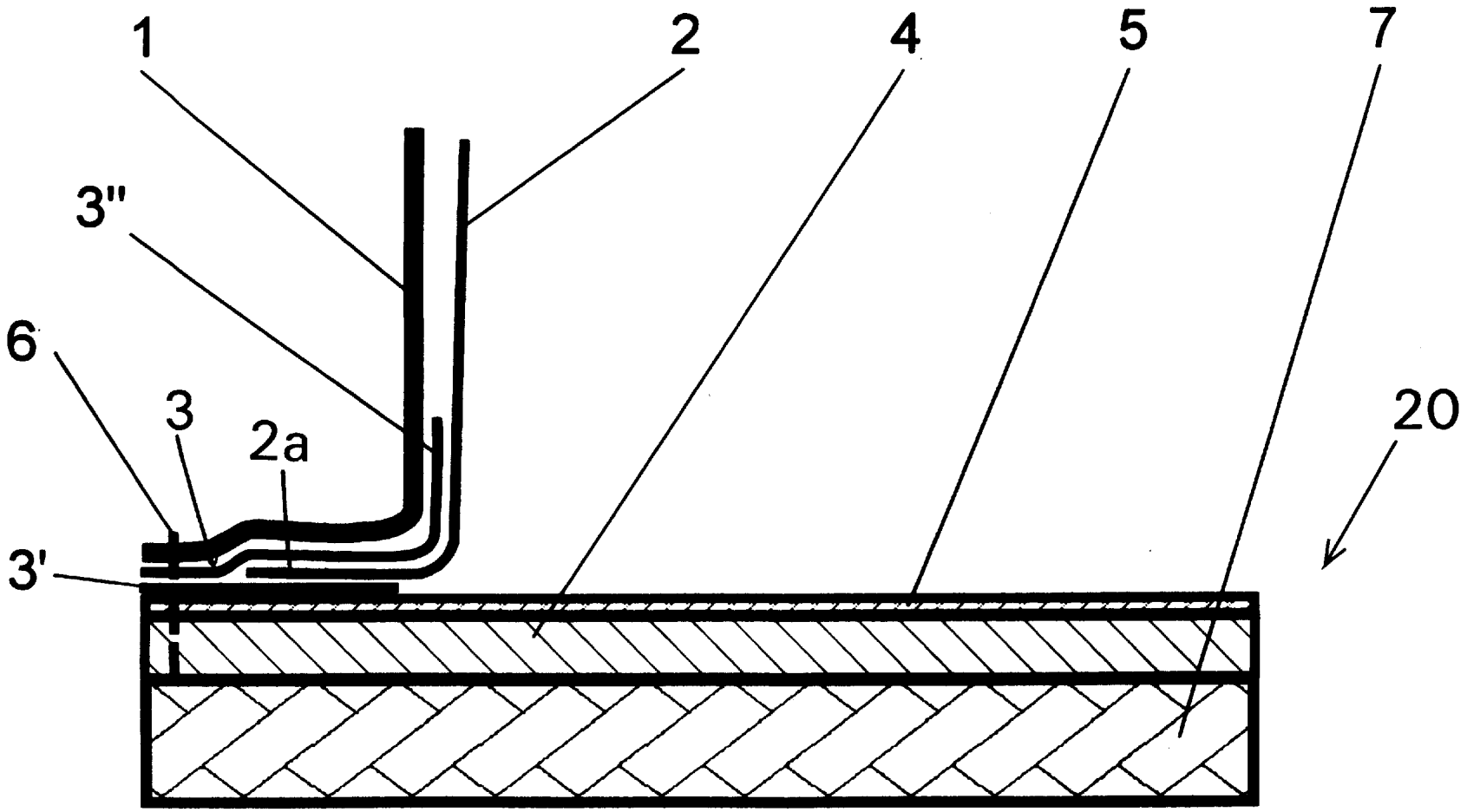
FIG. 2 shows a detail of a shoe structure of a second embodiment of the invention with a flex construction.

FIG. 2 shows a detail of a shoe structure of a second embodiment of the invention with a flex construction. In this example, the inner shaft 2 and the outer shaft 1 are turned back to the outside. Similar to the first embodiment, the inner shaft 2 is enclosed at its lower end 2*a* by two waterproof extension strips 3' and 3". Both extension strips 3' and 3" are glued in a waterproof manner to the lower end 2*a* of the inner shaft 2, and to one another in the portion that extends paste edge of the lower end 2*a*. The lower end of the outer shaft 1 and the ends of extension strips 3' and 3" are sewn to the insole 20 with a seam 6. A sole 7 is glued to the insole 4 from below. In order to protect the inner area of the shoe from any water which may penetrate the sole 7, the insole has an upper layer 5, which is waterproof.

Figure 3:
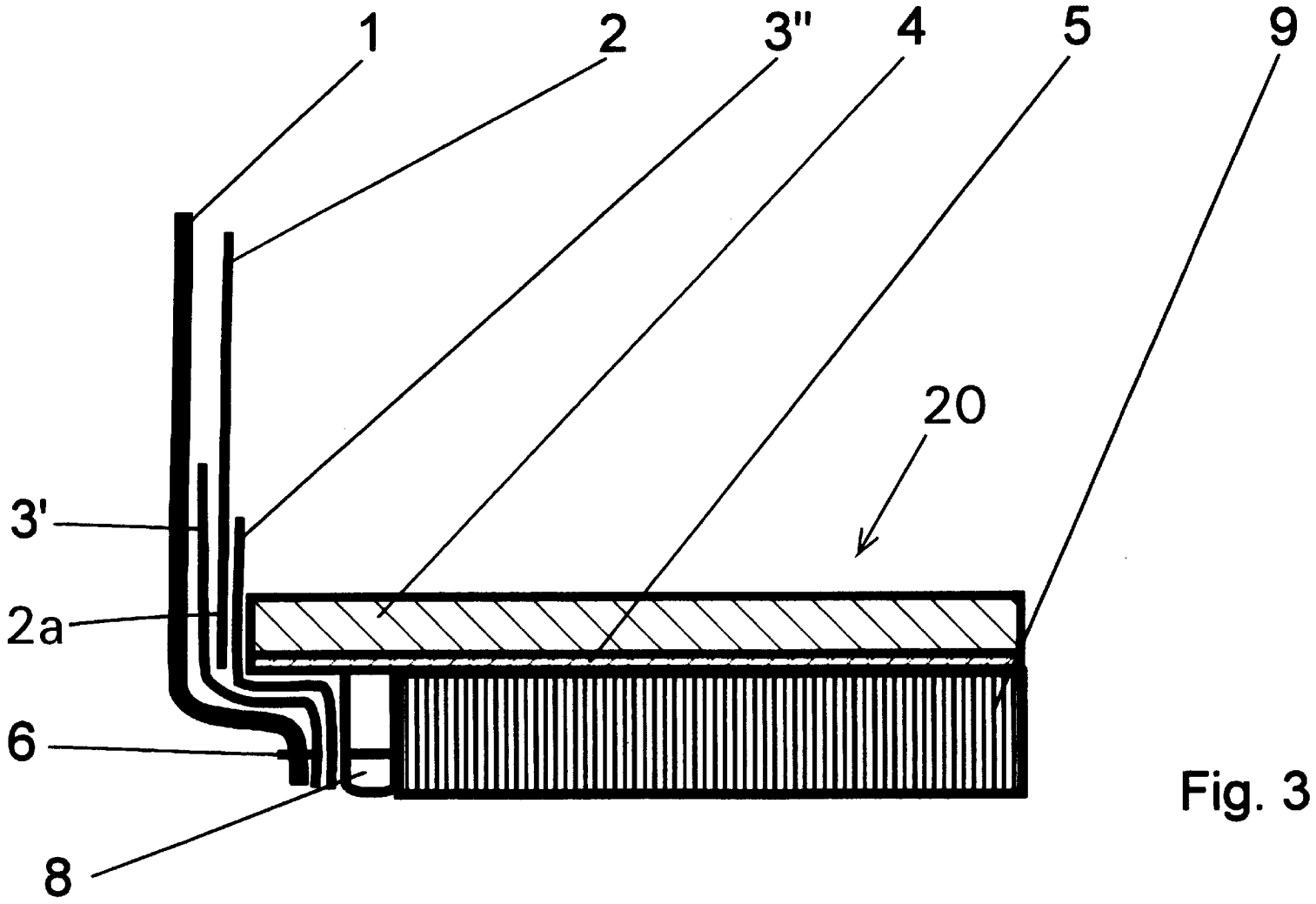
FIG. 3 shows a detail of a shoe structure of a third embodiment of the invention with Goodyear construction.

FIG. 3 shows a detail of a shoe structure of a third embodiment of the invention with Goodyear construction. In this embodiment, the insole 20 has an insole lip 8 around its circumference, to which extension strips 3' and 3" and the outer shaft 1 are sewn from the outside with seam 6. As in the first and second embodiments, the extension strips 3' and 3" are glued in a waterproof manner, at their lower end to each other, and at their upper end to the lower end 2*a* of the inner shaft 2 from the outside and inside, respectively. Both extension strips 3' and 3" are shaped to form caps during production of the shoe structure. A filler layer 9 is provided adjacent the insole lip 8 and the insole 20. In this embodiment, the insole 20 has a waterproof layer 5 on its lower surface. Finally, the outsole (not illustrated) is glued or, if suitable, injection molded into place from the bottom.

Figure 4:
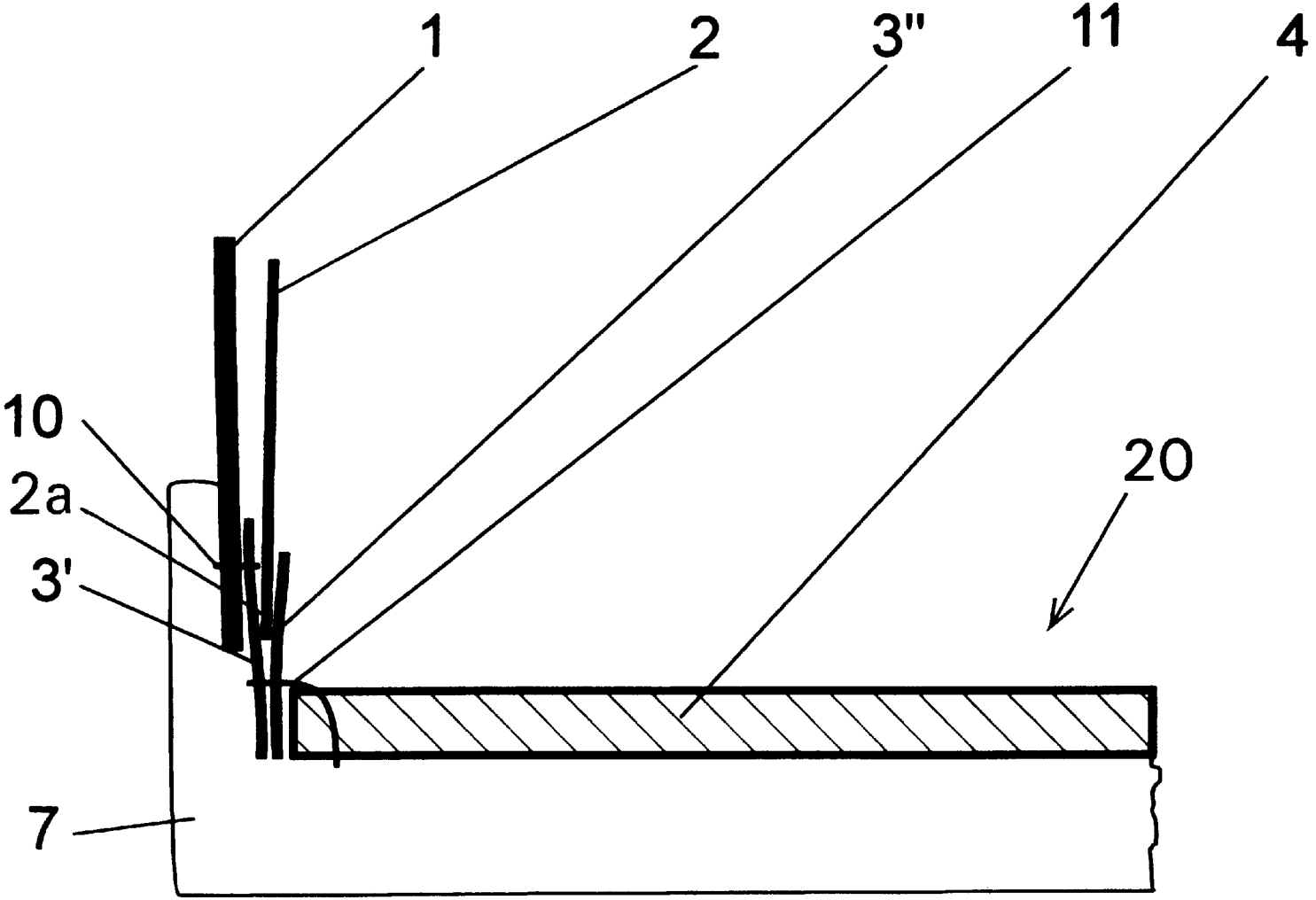
FIG. 4 shows a detail of a shoe structure of a fourth embodiment of the invention with Strobel construction.

FIG. 4 shows a detail of a shoe structure of a fourth embodiment of the invention with Strobel construction. The term "Strobel" means that parts of the shoe structure are joined together with a seam made on a sewing machine manufactured by the Strobel company. In the illustrated embodiment, the lower end 2*a* of the inner shaft 2 is enclosed by two extension strips 3' and 3", which are glued in a waterproof manner to the lower end 2*a* of the inner shaft 2 on one end and to each other on the other end. The outer shaft 1 is sewn to extension strip 3' with seam 10. The inner extension strip 3" covers the seam 10, so that contact between a wearer's foot and seam 10, which is often unpleasant, is avoided. Furthermore, the lower end of the extension strips 3' and 3", which are glued together, is sewn to the insole 20 with a Strobel seam 11. In this embodiment, the insole 20 may be made of a waterproof material. A sole 7 is injection molded onto the lower end of the outer shaft 1, the free end of extension strip 3' and the insole 20. Alternatively, the sole 7 may be suitably pre-formed and glued onto the outer shaft 1, the free end of extension strip 3' and the insole 20.

While the invention has been described in conjunction with the specific embodiments described above, many equivalent alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

What is claimed is:

1. A shoe structure comprising an outer shaft, an inner shaft and a sole, the inner shaft comprising at least one waterproof, water-vapor permeable functional layer and at least one layer of lining material which faces an inside of the shoe structure, a lower end of the inner shaft which faces the sole having an extension positioned on an inside of said outer shaft, the extension having a first portion that is connected by a waterproof connection to the lower end of the inner shaft and is made of a waterproof material, and a second portion extending beyond the lower end of the inner shaft, and the inner shaft being fixed in place in a sole area of the shoe structure by the second portion of the extension only by a seam that passes through the second portion of the extension and at least a portion of the sole.

2. The shoe structure as recited in claim 1, wherein the seam also passes through the outer shaft.

3. A shoe having the shoe structure as recited in claim 1.

4. A shoe structure comprising an outer shaft, an inner shaft and a sole, the inner shaft comprising at least one waterproof, water-vapor permeable functional layer and at least one layer of lining material which faces an inside of the shoe structure, a lower end of the inner shaft which faces the sole having an extension positioned on an inside of said outer shaft, the extension having a first portion that extends parallel to the inner shaft from a point above the sole to the sole, a second portion, and a third portion that extends substantially parallel to the sole, at least the third portion extending beyond said lower end of the inner shaft, at least said first portion of the extension being connected by a waterproof connection to the lower end of the inner shaft and being made of a waterproof material, the first portion and the third portion being connected by the second portion, and the inner shaft being fixed in place in a sole area of the shoe structure by the third portion of the extension only.

5. The shoe structure as recited in claim 1, wherein at least said first portion of the extension encloses the lower end of the inner shaft on both sides and is joined to the inner shaft by a waterproof connection.

6. The shoe structure as recited in claim 1, wherein the extension comprises two waterproof extension strips, each having first, second and third portions, which are positioned around the circumference of the lower end of the inner shaft and which are joined by a waterproof connection, respective at least first portions of the extensions strips being joined to an inside surface and an outside surface, respectively, of the lower end of the inner shaft, and respective at least said third portions of the extension strips which extend beyond said lower end of the inner shaft being joined together.

7. The shoe structure as recited in claim 1, wherein the extension is fixed in sole area by a connection with at least one of the outer shaft and an insole.

8. The shoe structure as recited in claim 1, wherein the connection of the extension to the inner shaft is made by at least one of a seam and a glued connection.

9. The shoe structure as recited in claim 1, being made with flex construction, in which a lower end of the outer shaft is turned back to the outside and sewn to an insole, the insole being connected underneath to an outsole, wherein at least said third portion of the extension is positioned between the turned-back end of the outer layer and the insole, and the turned-back end of the outer shaft, said third portion of the extension and the insole are sewn together.

10. The shoe structure as recited in claim 1, wherein the third portion of the extension is above an insole.

11. The shoe structure as recited in claim 1, wherein the third portion of the extension is below an insole.

12. A shoe having a shoe structure comprising an outer shaft, an inner shaft and a sole, the inner shaft comprising at least one waterproof, water-vapor permeable functional layer and at least one layer of lining material which faces an inside of the shoe structure, a lower end of the inner shaft which faces the sole having an extension positioned on an inside of said outer shaft, the extension having a first portion that extends parallel to the inner shaft from a point above the sole to the sole, a second portion, and a third portion that extends substantially parallel to the sole, at least the third portion extending beyond said lower end of the inner shaft, at least said first portion of the extension being connected by a waterproof connection to the lower end of the inner shaft and being made of a waterproof material, the first portion and the third portion being connected by the second portion, and the inner shaft being fixed in place in a sole area of the shoe structure by the third portion of the extension only.

* * * * *

UNITED STATES PATENT AND TRADEMARK OFFICE

CERTIFICATE OF CORRECTION

PATENT NO. : 6,088,935

DATED : July 18, 2000

INVENTOR(S) : Liviu-Mihai Pavelescu and Manfred Haderlein

It is certified that error appears in the above-identified patent and that said Letters Patent is hereby corrected as shown below:

Col. 3, line 42, after "outsole" replace " ' " with --,--; and line 64, replace "sowing" with --following--.

Col. 6, line 36, replace "1" with --4--;

line 40, replace "1" with --4--;

line 50, replace "1" with --4--;

line 51, before "sole" insert --the--;

line 53, replace "1" with --4--;

line 56, replace "1" with --4--;

line 64, replace "1" with --4--; and line 66, replace "1" with --4--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*